US006964405B2

(12) United States Patent
Marcichow et al.

(10) Patent No.: US 6,964,405 B2
(45) Date of Patent: Nov. 15, 2005

(54) SYSTEM AND METHOD FOR IMPROVED INSTALLATION AND CONTROL OF CONCEALED PLUMBING FLUSH VALVES

(75) Inventors: Martin Marcichow, Hoffman Estates, IL (US); Nhon T. Vuong, Lombard, IL (US); Paul Waterhouse, Hamilton (CA); Peter Zosimadis, Brampton (CA)

(73) Assignees: Sloan Valve Company, Franklin Park, IL (US); Smart Wave Technologies Corporation, (CA)

( * ) Notice: Subject to any disclaimer, the term of this patent is extended or adjusted under 35 U.S.C. 154(b) by 54 days.

(21) Appl. No.: 10/803,563

(22) Filed: Mar. 18, 2004

(65) Prior Publication Data

US 2005/0205817 A1 Sep. 22, 2005

(51) Int. Cl.[7] ..... E03D 5/00
(52) U.S. Cl. ..... 251/129.04; 4/623
(58) Field of Search ..... 251/129.04; 4/623

(56) References Cited

U.S. PATENT DOCUMENTS 5,155,481 A * 10/1992 Brennan et al. ..... 340/870.02
5,694,653 A * 12/1997 Harald ..... 4/623
6,206,340 B1 * 3/2001 Paese et al. ..... 251/129.04
6,219,859 B1 * 4/2001 Derakhshan ..... 4/677
6,279,173 B1 * 8/2001 Denzin et al. ..... 4/213
6,568,655 B2 * 5/2003 Paese et al. ..... 251/129.04
6,718,567 B2 * 4/2004 Gibson et al. ..... 4/508
2004/0025238 A1 * 2/2004 Parsons et al. ..... 4/378

* cited by examiner

*Primary Examiner*—J. Casimer Jacyna
(74) *Attorney, Agent, or Firm*—St. Onge Steward Johnston & Reens LLC

(57) ABSTRACT

The invention provides a radio frequency (RF) valve control system that replaces mechanical systems that physically links a button or a handle to a flush valve or hard wired electronic control systems that physically links a sensor/electronic switch to a valve actuator within a plumbing installation. The new system is characterized by two modules, a user interface module (UIM) for locating at or adjacent a plumbing fixture (such as a water closet or urinal), and a valve interface module (VIM) operatively connected to a flush valve actuator or a valve in the water supply line of the plumbing fixture. The UIM generally has the function of providing an RF valve control signal to the VIM and the VIM has the functions of receiving, analysing, and responding to the RF valve control signal and sending a signal to the valve actuator to initiate a flush cycle or initiating a valve control process to control a valve within the water supply line to start or stop water flow to the fixture. The system may be deployed as a single UIM/VIM pair or as multiple UIM/VIM pairs within a multi-fixture installation. In each case, each UIM/VIM pair communicates with its respective UIM or VIM in both a learning and active mode.

20 Claims, 9 Drawing Sheets

SYSTEM AND METHOD FOR IMPROVED INSTALLATION AND CONTROL OF CONCEALED PLUMBING FLUSH VALVES

FIELD OF THE INVENTION

The invention provides a radio frequency (RF) valve control system that replaces mechanical systems that physically links a button or a handle to a flush valve or hard wired electronic control systems that physically links a sensor/electronic switch to a valve actuator within a plumbing installation. The new system is characterized by two modules, a user interface module (UIM) for locating at or adjacent a plumbing fixture (such as a water closet or urinal), and a valve interface module (VIM) operatively connected to a flush valve actuator or a valve in the water supply line of the plumbing fixture. The UIM generally has the function of providing an RF valve control signal to the VIM and the VIM has the functions of receiving, analysing, and responding to the RF valve control signal and sending a signal to the valve actuator to initiate a flush cycle or initiating a valve control process to control a valve within the water supply line to start or stop water flow to the fixture. The system may be deployed as a single UIM/VIM pair or as multiple UIM/VIM pairs within a multi-fixture installation. In each case, each UIM/VIM pair communicates with its respective UIM or VIM in both a learning and active mode.

BACKGROUND OF THE INVENTION

In the commercial/institutional plumbing industry, there are a number of problems associated with typical water closet and urinal installations in commercial buildings.

A water closet or urinal installation will typically require a time-consuming and complicated manual installation. In particular, the installation of concealed plumbing fixtures that have mechanical buttons, handles, electronics, pipes and wires requires that each of these components must be precisely located and routed through walls with the result that the installation work is time-consuming and expensive.

For example, the installation of concealed flush valves using mechanical buttons or handles requires that the alignment of the mechanical linkage and the distance from the valve to the front of the exposed wall is precise with the result that many errors are made installing these devices. Furthermore, electronics must be located at specific locations relative to the fixture.

Moreover, mistakes made during installation that require post-installation repairs or repairs required due to vandalism or component failure are often difficult and expensive to effect as finished walls, floors and countertop surfaces may have to be removed, dismantled or replaced in order to gain access to and ultimately fix the problem.

Another problem with standard exposed commercial plumbing installations is that, in the case of a water closet, most mechanical and electronic actuators are located behind the water closet fixture. This arrangement of components requires that the user must reach over the water closet in order to flush the fixture which is unpleasant.

Accordingly, there remains a need to provide a system and method for improving plumbing installations that address the above shortcomings. More particularly, there remains a need for a plumbing fixture control system that can be easily and quickly installed without the need for complex routing of electronics or wiring through walls. Moreover, there is a need for plumbing systems that can be more easily repaired in the event of component failure or damage.

SUMMARY OF THE INVENTION

The above problems are addressed by providing a system having separate a user interface module and a valve interface module that are wirelessly linked such that a plumbing installation does not require the routing of wires between a user side and a behind-the-wall side of the plumbing installation.

In accordance with a first embodiment of the invention, there is provided a plumbing fixture installation and valve control system comprising: a user interface module (UIM) for installation adjacent a plumbing fixture, the UIM module having a UIM high frequency transmitter and a UIM low frequency receiver for communication in an active mode and a learning mode; a valve interface module (VIM) having a valve interface for operative connection to a valve, the VIM for controlling fluid flow through the valve, the VIM including a VIM high frequency receiver and a VIM low frequency transmitter for communication with the UIM; wherein the UIM high frequency transmitter, the UIM low frequency receiver, the VIM high frequency receiver and the VIM low frequency transmitter enable linking digital identities between the UIM and the VIM in the learning mode and for providing operative control of the valve in the active mode.

In further embodiments, the VIM includes a VIM processor for interpreting a high frequency master signal from the UIM and for responding to the high frequency master signal by activating the VIM low frequency transmitter to transmit the VIM digital identity in the learning mode. The VIM processor will also preferably interpret a high frequency valve control signal from the UIM and respond to the high frequency valve control signal to control fluid flow through the valve in the active mode. In a further embodiment, the UIM includes a UIM processor operatively connected to the UIM high frequency transmitter for instructing the UIM high frequency transmitter to transmit a high frequency master signal in the learning mode and a high frequency valve control signal in the active mode.

In a further embodiment, the UIM includes an activation system operatively connected to the UIM processor, the activation system responsive to a user input to cause the UIM high frequency transmitter to transmit the high frequency valve control signal in the active mode. The activation system may be active or passive and may be touch or touchless.

In one embodiment, the VIM initiates a flush cycle of the valve.

In a still further embodiment, the UIM includes an audio or visual output system operatively connected to the UIM processor for providing audio or visual output to a user during the learning mode to signal linking digital identities and/or for providing audio or visual output to a user during the active mode.

In yet another embodiment, the system includes a learning mode activation device, the learning mode activation device for operative communication with a UIM for activating the UIM into the learning mode.

In still yet another embodiment, the system provides an electronic control for operative connection between at least one VIM and at least one corresponding valve, the electronic controller for receiving flush signals from each VIM and for allowing or denying each flush signal to be sent to each corresponding valve on the basis of a predetermined algorithm.

In a more specific embodiment, the invention also provides a plumbing fixture installation and valve control system comprising: a user interface module (UIM) for installation adjacent a plumbing fixture, the UIM module having: a UIM high frequency transmitter and a UIM low frequency receiver for communication in an active mode and a learning mode; a UIM processor operatively connected to the UIM high frequency transmitter for instructing the UIM high frequency transmitter to transmit a high frequency master signal in the learning mode and a high frequency valve control signal in the active mode; an activation system operatively connected to the UIM processor, the activation system responsive to a user input to cause the UIM high frequency transmitter to transmit the high frequency valve control signal in the active mode; a valve interface module (VIM) for operative connection to a valve for controlling fluid flow through the valve and, in the learning mode, for communication with the UIM to link digital identities between the UIM and VIM and, in the active mode, to provide operative control of the valve, the VIM having: a valve interface for operative connection to the valve; a VIM high frequency receiver and a VIM low frequency transmitter for communication with the UIM; a VIM processor for, in the learning mode, interpreting a high frequency master signal from the UIM and for responding to the high frequency master signal by activating the VIM low frequency transmitter to transmit a VIM digital identity and, in the active mode, for interpreting a high frequency valve control signal from the UIM and responding to the high frequency valve control signal to control fluid flow through the valve.

In a still further embodiment, the invention also provides a method for linking a user interface module (UIM) and a valve interface module (VIM) in a plumbing installation and for providing operative control of a plumbing fixture, the UIM having a UIM high frequency transmitter and a UIM low frequency receiver and the VIM having a VIM high frequency receiver and a VIM low frequency transmitter, the method comprising the steps of: in a learning mode: transmitting a high frequency master signal from the UIM to the VIM; activating the VIM in response to the high frequency master signal; transmitting a unique digital identity at a low frequency from the VIM to the UIM and recording the unique digital identity in the UIM; and, in an active mode: transmitting a high frequency valve control signal encoded with the unique digital identity from the UIM to the VIM; and, activating a valve control process in the VIM in response to the valve control signal.

BRIEF DESCRIPTION OF THE DRAWINGS

The invention is described with reference to the following drawings wherein.

DETAILED DESCRIPTION OF THE INVENTION

With reference to the Figures, an improved system and method for installation of concealed plumbing flush valves is described.

More specifically, the invention provides a radio frequency (RF) valve control system that replaces mechanical devices that physically link a button or handle to a flush valve as well as electronic valve control systems that are connected to a valve actuator by a cable. The system is characterized by two modules, a user interface module (UIM) which is located on the user side of a plumbing fixture (such as a water closet, faucet, or urinal), and a valve interface module (VIM) operatively connected to a flush valve (or faucet) of the individual plumbing fixture. The UIM generally has the function of providing an RF valve control signal to the VIM and the VIM has the function of receiving, analysing, and responding to the RF valve control signal and to initiate a flush cycle or to initiate a valve control process to control a valve within the water supply line to start or stop water flow to the fixture. The system may be deployed as a single UIM/VIM pair or as multiple UIM/VIM pairs within a multi-fixture installation. In each case, each UIM/VIM pair communicates with its respective UIM or VIM in both a learning and active mode as will be explained in greater detail below.

Figure 1A:
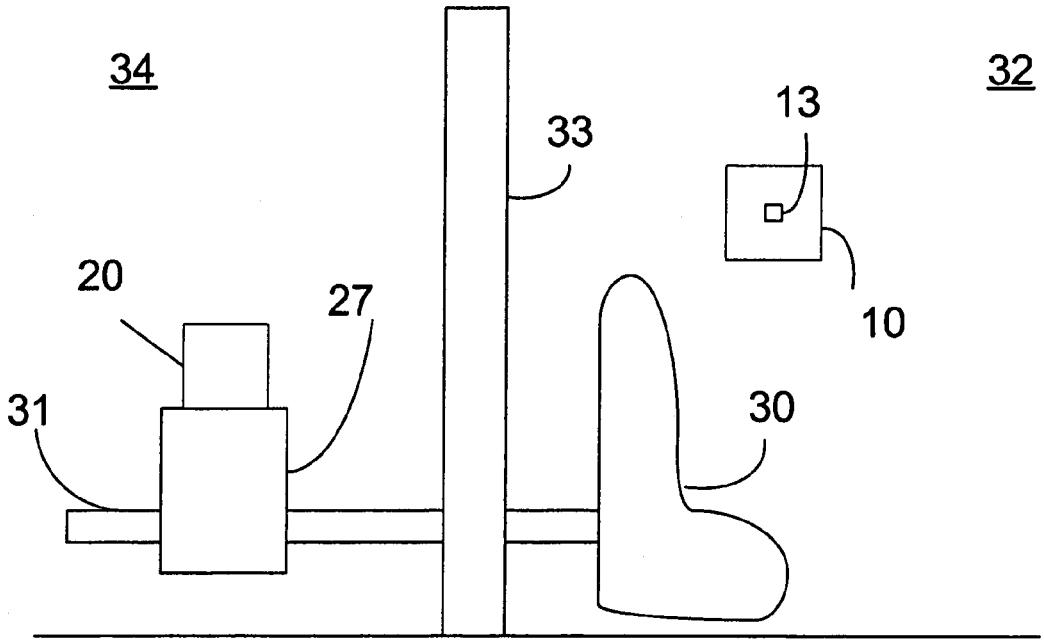
FIG. 1A is a schematic representation of a typical plumbing fixture installation in accordance with the invention.

In a typical installation as shown in FIG. 1A, a user interface module (UIM) 10 is installed at each plumbing fixture 30, a flush valve 27 is installed in operative communication with the water supply line 31 of the fixture and a valve interface module (VIM) 20 is operatively connected to the flush valve 27. The VIM 20 may include an actuator for initiating a flush cycle, or, in one embodiment, an integral valve for attachment to the water supply line 31. In many installations, particularly commercial installations, the UIM is installed on the fixture or user side 32 of a wall 33 and the VIM is installed behind-the-wall 33 possibly in a service area or plumbing chase 34.

Generally, during installation, an installer will establish an active and specific communication link between specific UIM/VIM pairs whilst the UIM and VIM are in a learning mode. Subsequent to the establishment of an active communication link, the UIM/VIM will operate in an active mode. In the active mode, a user approaches a plumbing fixture and initiates the valve control process either actively or passively as will be described in greater detail below.

Figure 1B:
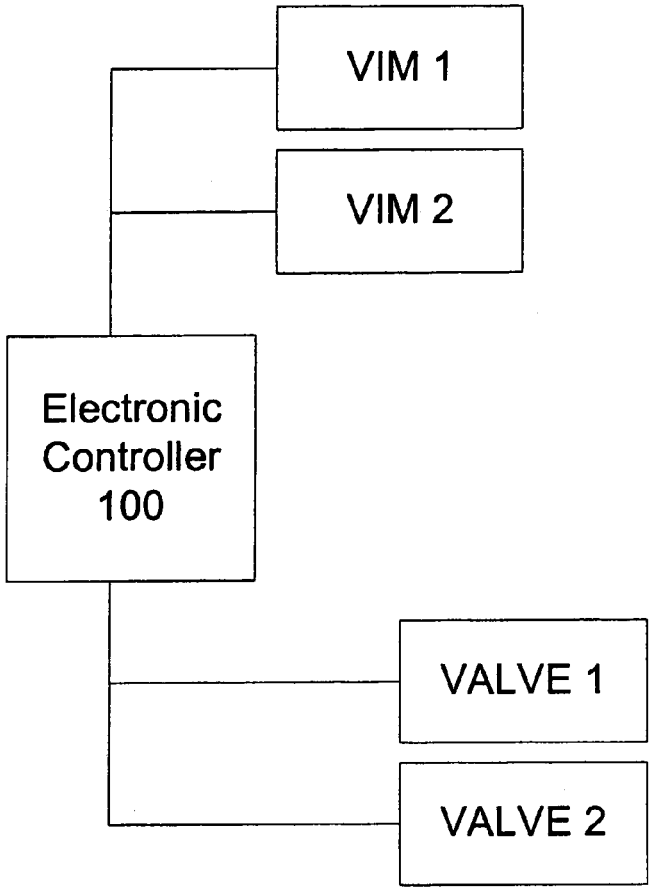
FIG. 1B is a schematic representation of an alternate installation in accordance with the invention.

FIG. 1B illustrates another installation wherein a further electronic controller 100 is installed between a plurality of VIMs (shown as VIM 1 and VIM 2 in FIG. 1B) and their corresponding valves (Valve 1 and Valve 2). This installation is contemplated in institutional settings where system wide control of water flow may be required to plumbing fixtures. This installation is specifically contemplated for prisons where coordinated actions by inmates can cause damage to plumbing systems.

In this installation, the electronic controller 100 receives flush signals from each of the configured VIMs and, according to predetermined control algorithms will either allow or deny the flush signal to be sent to a corresponding valve. For example, in the event that the electronic controller 100 receives multiple flush signals from a predetermined number of VIMs within a specified time, the controller may prevent the flush signals from being transmitted to the corresponding valves so as to prevent a system overload.

User Interface Module 10

Figure 2:
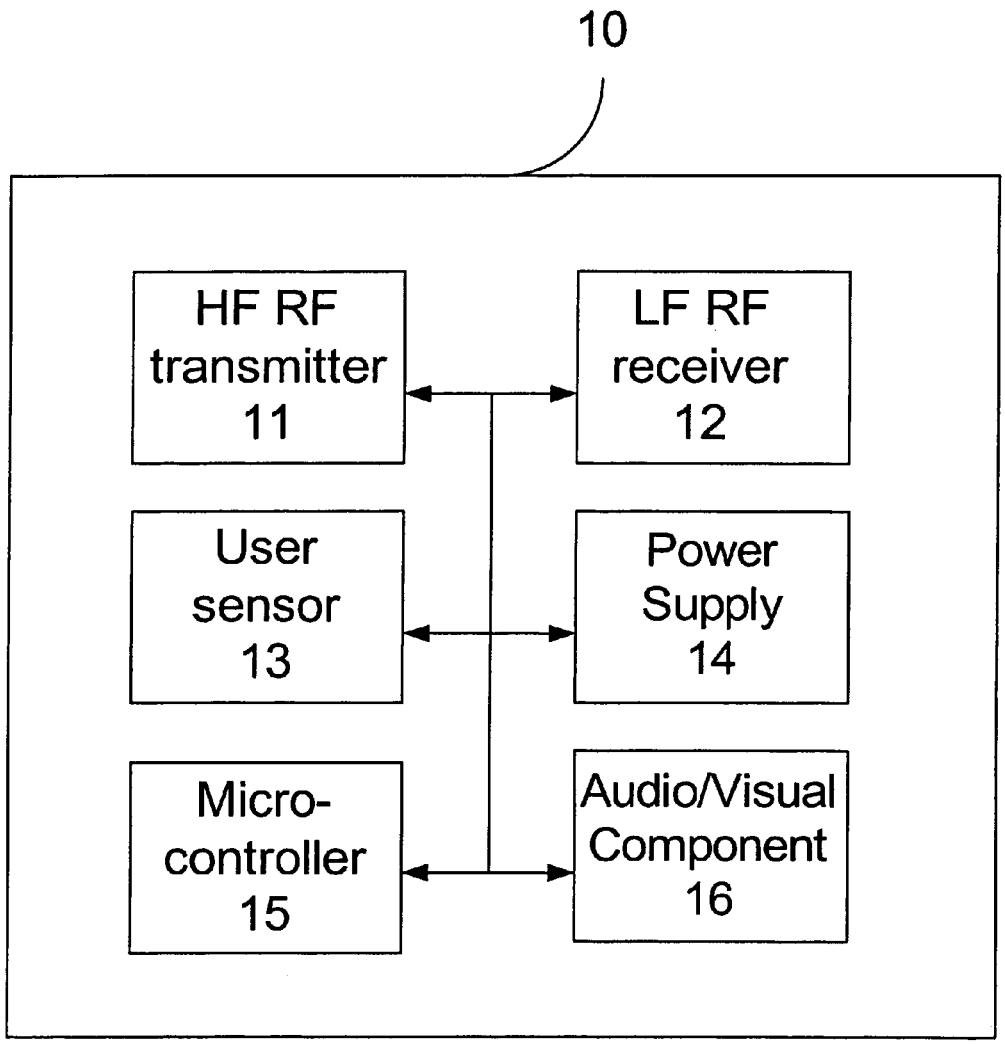
FIG. 2 is a schematic diagram of a user interface module.

With reference to FIG. 2, the UIM 10 generally includes six sub-systems; a high frequency RF transmitter 11 for sending high frequency RF valve control signals to the valve interface module 20; a low frequency RF receiver 12 for receiving low frequency RF signals from the associated valve module 20 during the learning mode; an activation system 13 for initiating the valve-control process; a micro-controller 15 for controlling the UIM subsystems; an optional audio or visual component 16 for providing feedback to the user or installer; and a power supply 14 to supply power to the UIM 10 subsystems.

For the purposes of the description, low frequency radio waves are radio waves having a transmission range of approximately 5–10 feet and are directional, and high frequency radio waves are radio waves having a range up to 300+ feet, and are omni-directional.

Furthermore, the activation system may be either active or passive. That is, in one embodiment of the UIM, the valve control process is actively initiated by user-directed actions such as touching a push button (touch activation) or by a user specifically approaching a proximity sensor (touchless activation). In another embodiment of the UIM, the valve control process is passively initiated by a user sensor that detects the coarser movements of a user arriving or leaving the area detected by the sensor.

Valve Interface Module 20

Figure 3:
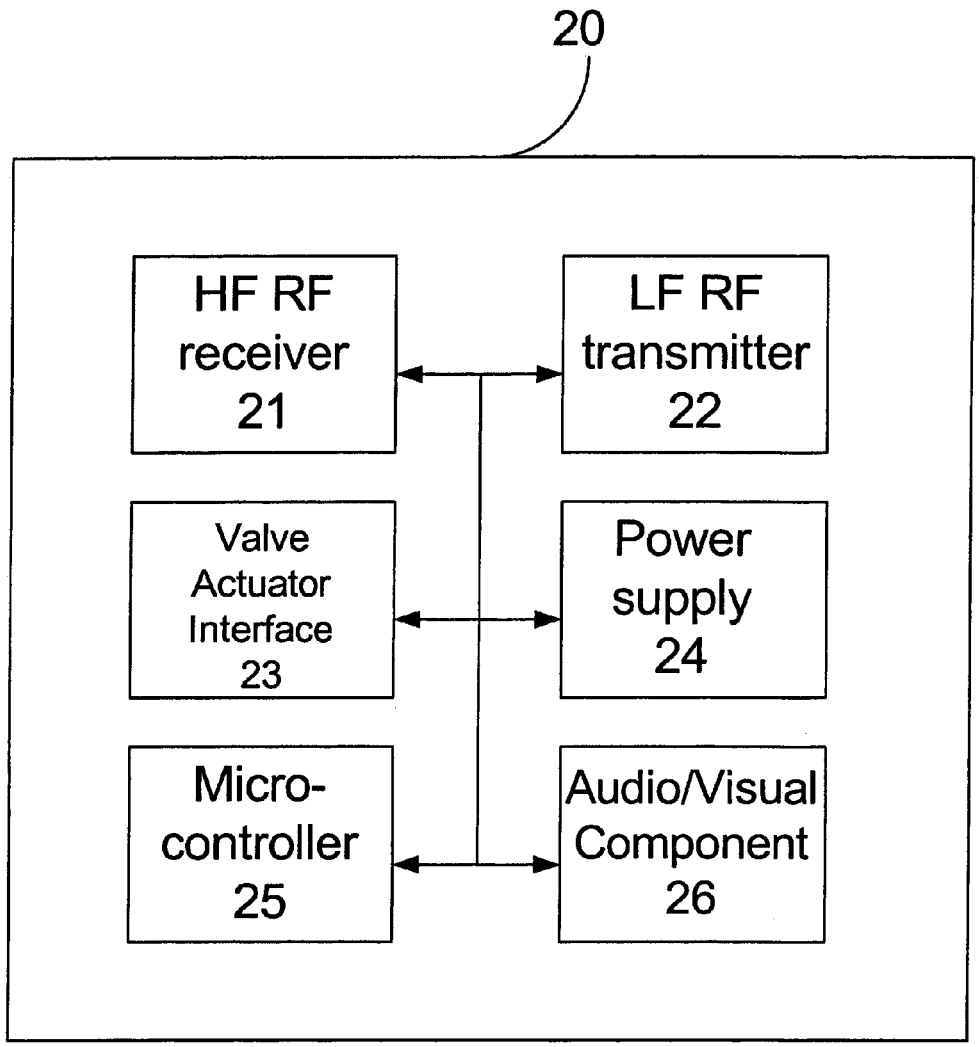
FIG. 3 is a schematic diagram of a valve interface module.

As illustrated in FIG. 3, the valve interface module 20 preferably includes six components: a high frequency RF receiver 21 for receiving high frequency RF signals from the high frequency RF transmitter 11 of the UIM 10, a low frequency RF transmitter 22 for sending low frequency RF signals to the associated UIM 10 during RF identity training (as will be described below); a valve actuator interface 23 for interfacing with a flush valve actuator to initiate a flush cycle or a valve to open and close a valve within the water supply line 31; a power supply for supplying power to all valve module 20 subsystems; and an optional audio or visual component 26 for providing feedback to the installer or user.

General Operation

Figure 4:
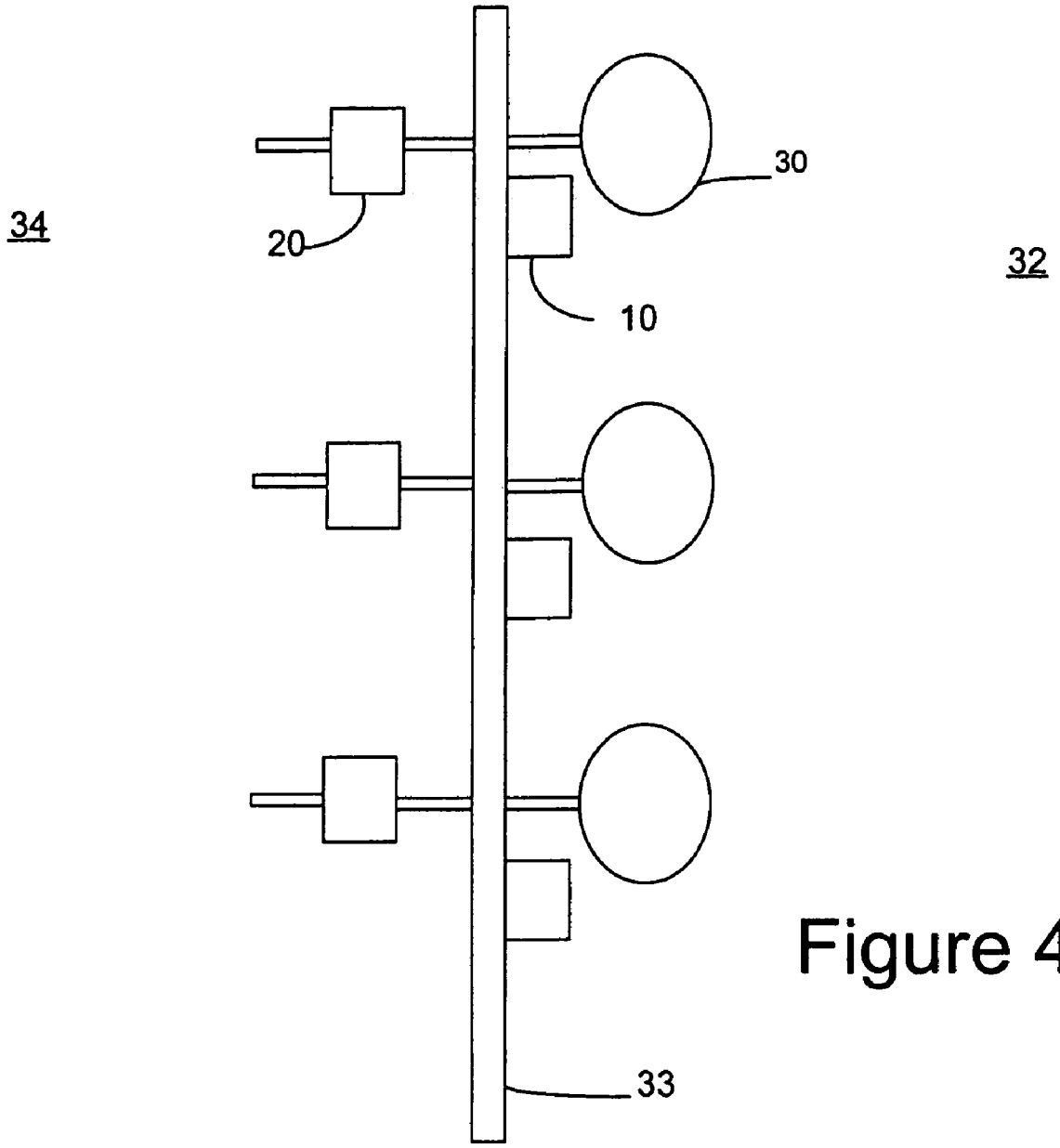
FIG. 4 is a plan view of a typical multiple-fixture installation.

In a typical public restroom, several fixtures 30 may be arranged in close proximity as shown in FIG. 4. In order to allow independent valve control of each fixture 30, each user interface module 10 is associated only with one fixture 30 and is capable of sending specific valve control signals to its corresponding valve interface module 20 to cause only the corresponding fixture 30 to be controlled. Therefore, the valve control signals must be specifically recognized by the valve interface modules 20 as being initiated by the corresponding user interface module 10, without responding to valve control signals periodically initiated by other user interface modules 10 of other closely spaced fixtures 30. In order to allow this degree of specificity, a digital identity is assigned to each UIM/VIM pair during installation during the learning mode.

Learning Mode

Figure 5:
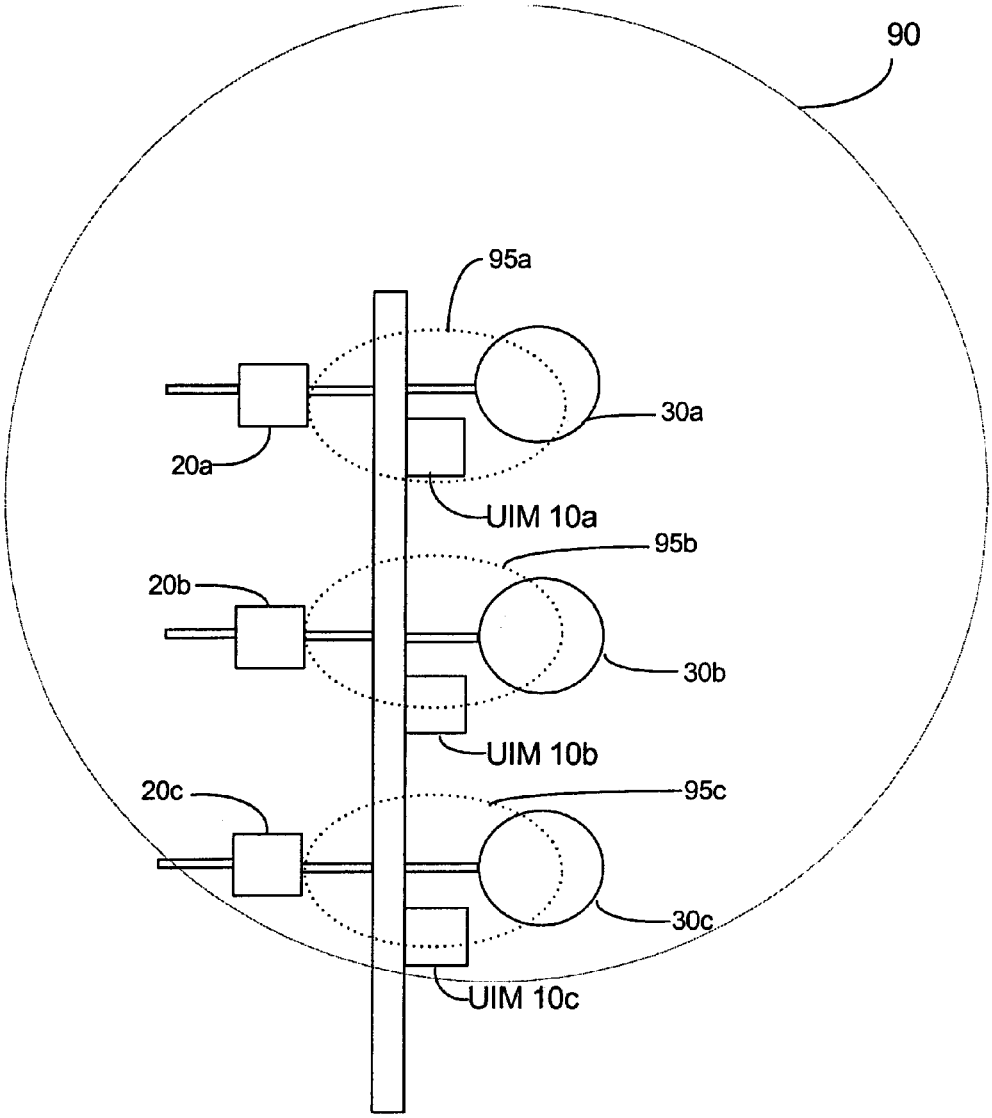
FIG. 5 is a schematic plan view of a typical multiple-fixture installation showing typical ranges for high and low frequency signals.

For example and with reference to FIG. 5, separate fixtures 30*a*, 30*b*, and 30*c* may be installed within a restroom with corresponding valve interface modules 20*a*, 20*b*, and 20*c*. Preferably each valve interface module is provided with a unique factory-installed digital identity in order to minimize the risk of adjacent VIMs having the same digital ID. It is however, contemplated that a VIM could enable a digital identity to be manually set. After appropriate connection of the VIMs to the flush valve, the installer will then initiate the RF identity training process for a single UIM/VIM pair by selecting a user interface module (for example 10*a*) and holding the user interface module 10*a* in close proximity to its corresponding valve interface module 20*a* (preferably against the wall 33 as shown in FIG. 5). The installer will activate the learning mode through an appropriate action (such as pressing and holding a UIM button, activation through a separate key or through another mode shifting action) which will cause a high frequency RF master signal to be generated by the high frequency RF transmitter 11 of the UIM 10*a*.

This high frequency signal will be transmitted to all valve interface modules 20 within transmitting range 90 of the transmitting user interface module 10*a*. Therefore, in the case illustrated by FIG. 5, all valve modules 20*a*, 20*b*, and 20*c* will receive the high frequency RF master signal at their high frequency RF receiver 21. Each VIM will respond to the RF master signal by transmitting their unique digital identities by generating a low frequency RF signal from their low frequency RF transmitters 22.

As defined above, the low frequency RF transmissions 95*a*, 95*b*, and 95*c* have limited range and direction, therefore the only low frequency signal received by the low frequency receiver of the user interface module 10*a* will be that of the corresponding valve interface module 20*a* (ie signal 95*a*). The UIM will then record the digital identity of the corresponding VIM within the UIM. After the digital identity has been successfully recorded within the UIM, the learning mode has been completed.

Figure 6:
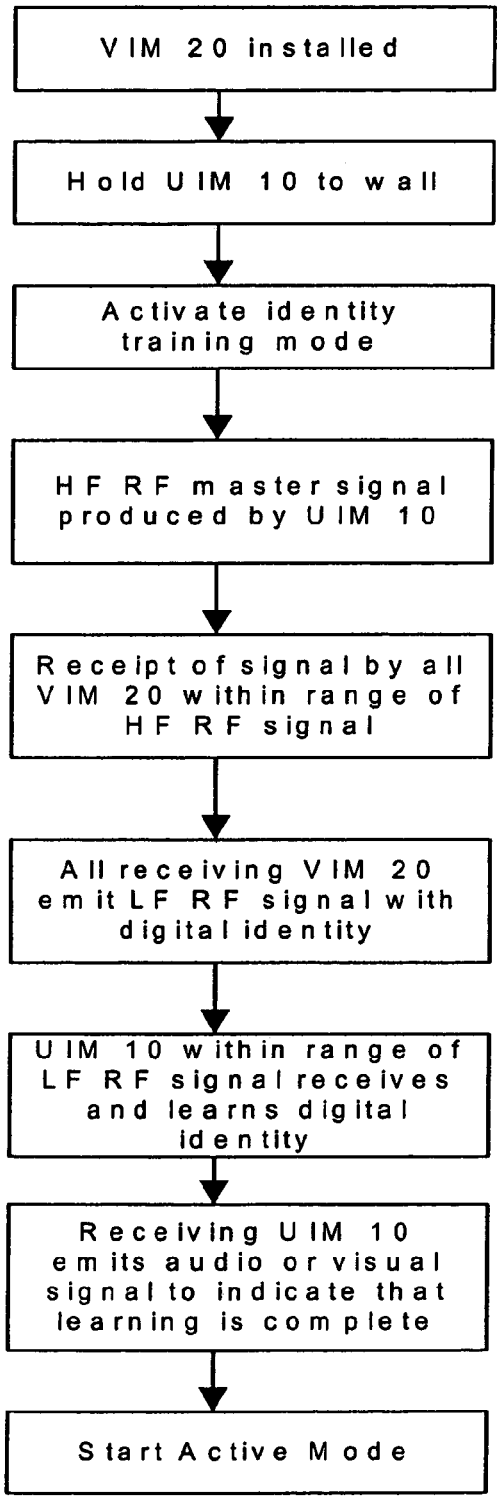
FIG. 6 is flow chart detailing an installation process in accordance with the invention.

In one embodiment, when the identity learning is complete, the audio/visual component 16 of a user interface module 10, if present, will emit an audible or visible signal to indicate that the user interface module 10 has learned the identity of valve interface module 20. The installer may then fully secure or attach the UIM at its appropriate location for that fixture, if required. The identity training process will then be repeated for the remaining fixtures 30*b* and 30*c*. For clarity, the identity learning process described above is shown generally in FIG. 6.

Active Mode

Following installation, the UIM and VIM will operate in the active mode. Switching between the learning mode and the active mode may be automatic upon completion of the learning mode or may be manually activated.

Figure 7:
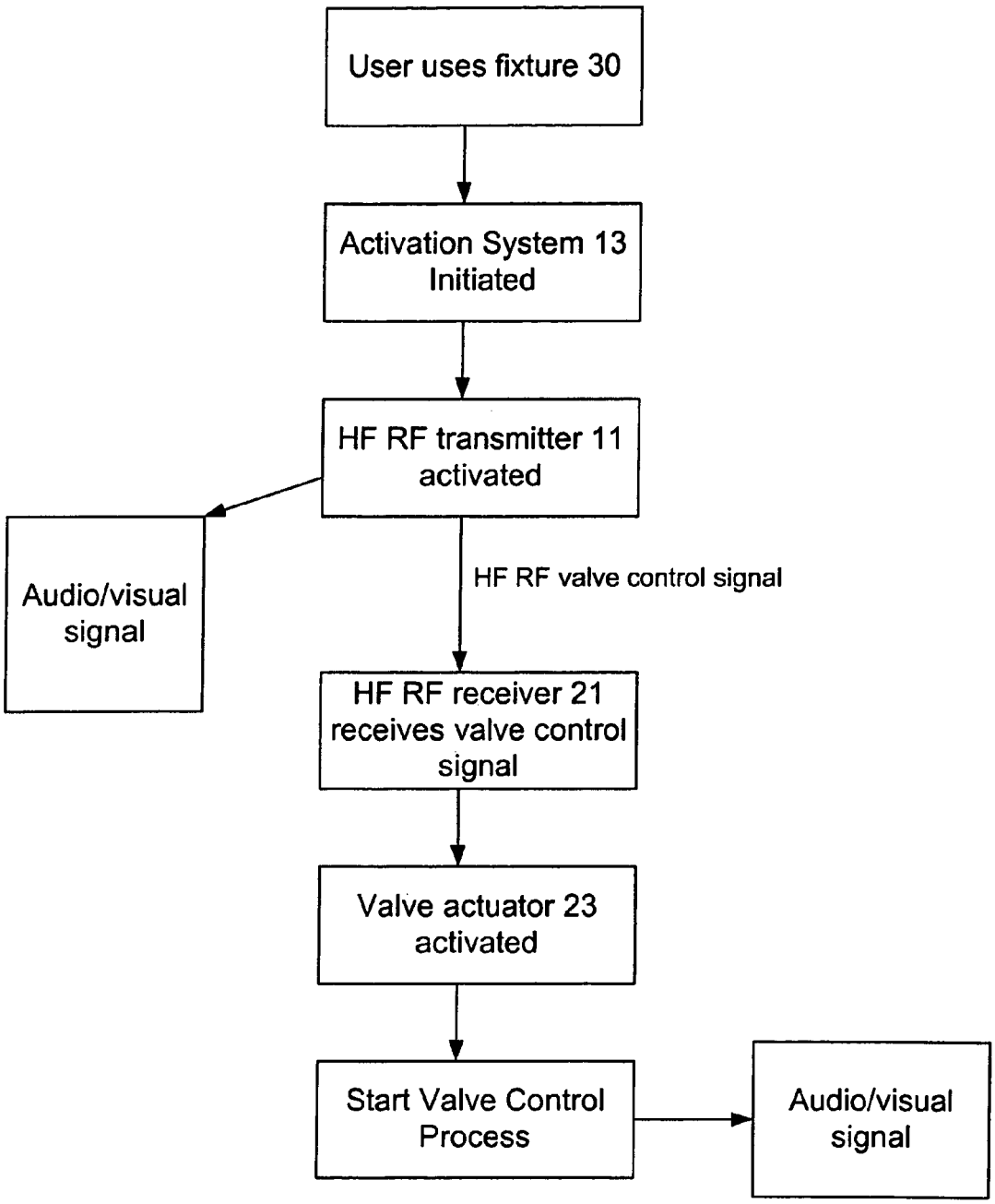
FIG. 7 is a flow chart detailing an active mode process in accordance with the invention; and, FIG. 8 is a flow chart detailing a command process within the valve interface module in accordance with the invention.

With reference to FIG. 7, during the active mode, triggering the activation system of the UIM will cause the high frequency RF transmitter 11 to generate a high frequency RF valve control signal. In one embodiment, an audio or visual signal may simultaneously be produced by the user interface module 10 to notify the user that the valve control process has been initiated.

The high frequency RF signal is encoded with the specific digital identity of its corresponding VIM and will be received by the high frequency RF receiver 21 of the valve interface module 20 (as well as other VIMs in range). The VIM having the digital identity encoded by the high frequency RF signal will respond to the high frequency RF signal and initiate the valve control process or flush cycle. In various embodiments, the valve control process will be determined by the specific water/user requirements of the specific fixture.

Post-Installation Servicing

At any time after installation, if field repairs or replacements are required, the above learning procedure can be repeated to pair-up any user interface module 10 with any desired valve interface module 20. Reactivation of the learning mode within the UIM will erase any previously learned valve interface module 20 digital identity, thereby allowing a new pairing of user interface 10 with valve module 20.

Other Embodiments

The procedure and means for the activation and deactivation of the learning mode should preferably be secured against unauthorized or inadvertent tampering by the public. Such steps may include systems such as hidden or coded-sequence buttons, keys or separate electronic devices.

In the example of a separate electronic device, this activation device may be a low frequency transmitter that can transmit low frequency activation and/or deactivation RF signals to individual user interface modules, or may be a high frequency RF transmitter that emits a master signal to cause valve interface modules to emit their low frequency digital identities for learning by the user interface module.

Figure 8:
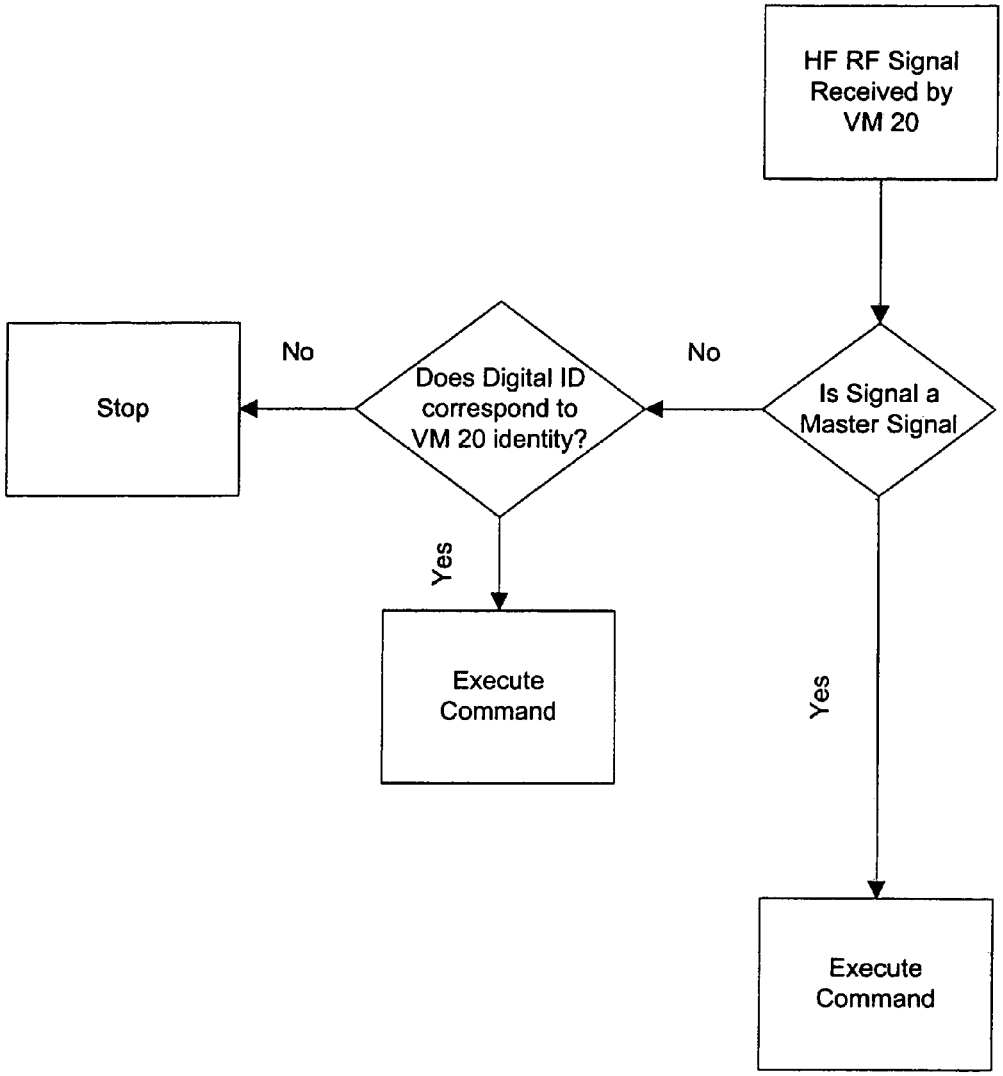

As noted above, the high frequency valve control signal of a UIM and the high frequency master signal differ in that the valve control signal is emitting a unique digital identity. With reference to FIG. 8, when a high frequency RF receiver 22 within a valve module receives a high frequency RF signal, the valve interface module 20 will determine whether the signal contains a digital identity.

In further embodiments, additional functionality can be introduced to the system by encoding additional information within the RF signals. In a preferred embodiment, the high frequency RF or low frequency signals will contain the following information:

Pre-Amble-Digital ID-Command-Post Amble

In this case, corresponding high or low frequency receivers will receive a signal and interpret the signal based on the coding format. For example, the VIM micro controller will examine the digital ID of the signal, and determine if it corresponds to an acceptable ID (that is, either a VIM ID or it represents a Master ID). In either case, if the ID is accepted, a specific command (such as flush valve, transmit VIM Digital ID, activate audio/video module, or any other function) can be executed.

In a further embodiment, a hand-held device having both an HF and LF transmitter/receiver can be provided that enables a hand-held device to operate either the user interface module or valve interface module. For example, a hand-held device can be used to flush all VIMs within range by transmitting a HF Master signal, with a command to flush. Alternatively the HF Master signal with a command to transmit the digital ID can also be sent. Still further, an LF Master signal with a command to activate the nearest user module can also be sent.

The power supply 14, 24, may be a battery or AC power source.

What is claimed is:

1. A plumbing fixture installation and valve control system comprising:

a user interface module (UIM) for installation adjacent a plumbing fixture, the UIM module having a UIM high frequency transmitter and a UIM low frequency receiver for communication in an active mode and a learning mode;

a valve interface module (VIM) having a valve interface for operative connection to a valve, the VIM for controlling fluid flow through the valve, the VIM including a VIM high frequency receiver and a VIM low frequency transmitter for communication with the UIM;

wherein the UIM high frequency transmitter, the UIM low frequency receiver, the VIM high frequency receiver and the VIM low frequency transmitter enable linking digital identities between the UIM and the VIM in the learning mode and for providing operative control of the valve in the active mode.

2. A plumbing fixture and valve control system as in claim 1 wherein the VIM includes a VIM processor for interpreting a high frequency master signal from the UIM and for responding to the high frequency master signal by activating the VIM low frequency transmitter to transmit the VIM digital identity in the learning mode.

3. A plumbing fixture and valve control system as in claim 1 wherein the VIM includes a VIM processor for interpreting a high frequency valve control signal from the UIM and for responding to the high frequency valve control signal to control fluid flow through the valve in the active mode.

4. A plumbing fixture and valve control system as in claim 1 wherein the UIM includes a UIM processor operatively connected to the UIM high frequency transmitter for instructing the UIM high frequency transmitter to transmit a high frequency master signal in the learning mode and a high frequency valve control signal in the active mode.

5. A plumbing fixture and valve control system as in claim 4 wherein the UIM includes an activation system operatively connected to the UIM processor, the activation system responsive to a user input to cause the UIM high frequency transmitter to transmit the high frequency valve control signal in the active mode.

6. A plumbing fixture and valve control system as in claim 5 wherein the activation system is an active activation system.

7. A plumbing fixture and valve control system as in claim 5 wherein the activation system is a passive activation system.

8. A plumbing fixture and valve control system as in claim 6 wherein the active activation system is a touchless activation system.

9. A plumbing fixture and valve control system as in claim 6 wherein the active activation system is a touch activation system.

10. A plumbing fixture and valve control system as in claim 1 wherein the VIM initiates a flush cycle of the valve.

11. A plumbing fixture and valve control system as in claim 4 wherein the UIM includes an audio or visual output system operatively connected to the UIM processor for providing audio or visual output to a user during the learning mode to signal linking digital identities.

12. A plumbing fixture and valve control system as in claim 4 wherein the UIM includes an audio or visual output system operatively connected to the UIM processor for providing audio or visual output to a user during the active mode.

13. A plumbing fixture and valve control system as in claim 1 further comprising a learning mode activation device, the learning mode activation device for operative communication with a UIM for activating the UIM into the learning mode.

14. A plumbing fixture and valve control system as in claim 1 wherein the UIM high frequency transmitter transmits a high frequency signal encoded with a preamble, digital ID, command and postamble.

15. A plumbing fixture and valve control system as in claim 1 further comprising an electronic control for operative connection between at least one VIM and at least one corresponding valve, the electronic controller for receiving flush signals from each VIM and for allowing or denying each flush signal to be sent to each corresponding valve on the basis of a predetermined algorithm.

16. A plumbing fixture installation and valve control system comprising:

a user interface module (UIM) for installation adjacent a plumbing fixture, the UIM module having:

a UIM high frequency transmitter and a UIM low frequency receiver for communication in an active mode and a learning mode;

a UIM processor operatively connected to the UIM high frequency transmitter for instructing the UIM high frequency transmitter to transmit a high frequency master signal in the learning mode and a high frequency valve control signal in the active mode;

an activation system operatively connected to the UIM processor, the activation system responsive to a user input to cause the UIM high frequency transmitter to transmit the high frequency valve control signal in the active mode;

a valve interface module (VIM) for operative connection to a valve for controlling fluid flow through the valve and, in the learning mode, for communication with the UIM to link digital identities between the UIM and VIM and, in the active mode, to provide operative control of the valve, the VIM having:

a valve interface for operative connection to the valve;

a VIM high frequency receiver and a VIM low frequency transmitter for communication with the UIM;

a VIM processor for, in the learning mode, interpreting a high frequency master signal from the UIM and for responding to the high frequency master signal by activating the VIM low frequency transmitter to transmit a VIM digital identity and, in the active mode, for interpreting a high frequency valve control signal from the UIM and responding to the high frequency valve control signal to control fluid flow through the valve.

17. A plumbing fixture and valve control system as in claim 16 wherein the UIM includes an audio or visual output system operatively connected to the UIM processor for providing audio or visual output to a user during the learning mode to signal linking digital identities.

18. A plumbing fixture and valve control system as in claim 16 wherein the UIM includes an audio or visual output system operatively connected to the UIM processor for providing audio or visual output to a user during the active mode to signal operation.

19. A method for linking a user interface module (UIM) and a valve interface module (VIM) in a plumbing installation and for providing operative control of a plumbing fixture, the UIM having a UIM high frequency transmitter and a UIM low frequency receiver and the VIM having a VIM high frequency receiver and a VIM low frequency transmitter, the method comprising the steps of:

in a learning mode:

transmitting a high frequency master signal from the UIM to the VIM;

activating the VIM in response to the high frequency master signal;

transmitting a unique digital identity at a low frequency from the VIM to the UIM and recording the unique digital identity in the UIM; and, in an active mode:

transmitting a high frequency valve control signal encoded with the unique digital identity from the UIM to the VIM; and, activating a valve control process in the VIM in response to the valve control signal.

20. A method as in claim 19 wherein at least two VIMs are linked to a single UIM.

* * * * *